US009476166B2

(12) United States Patent
Hydock

(10) Patent No.: US 9,476,166 B2
(45) Date of Patent: Oct. 25, 2016

(54) SYSTEM FOR REGULATING TEMPERATURE AND MOISTURE ON A FIELD

(71) Applicant: Gary J. Hydock, Great Valley, NY (US)

(72) Inventor: Gary J. Hydock, Great Valley, NY (US)

( * ) Notice: Subject to any disclaimer, the term of this patent is extended or adjusted under 35 U.S.C. 154(b) by 366 days.

(21) Appl. No.: 14/312,223

(22) Filed: Jun. 23, 2014

(65) Prior Publication Data

US 2015/0368866 A1 Dec. 24, 2015

(51) Int. Cl.

| | |
|---|---|
| ***A63C 19/00*** | (2006.01) |
| ***E01C 13/02*** | (2006.01) |
| ***E01C 11/26*** | (2006.01) |

(52) U.S. Cl.

CPC ..... *E01C 13/02* (2013.01); *E01C 11/26* (2013.01)

(58) Field of Classification Search

CPC ..... A63C 17/00; A63C 19/00; H01L 23/427; H01L 23/473; E01C 11/26; E01C 13/02
USPC ..... 472/88–90; 482/71; 165/45, 168, 171
See application file for complete search history.

(56) References Cited

U.S. PATENT DOCUMENTS

| | | | | |
|---|---|---|---|---|
| 2,726,593 | A | 12/1955 | Lahti | |
| 2,878,651 | A * | 3/1959 | Heinzelman | E01C 13/105 165/56 |
| 4,212,348 | A | 7/1980 | Kobayashi | |
| 4,270,596 | A * | 6/1981 | Zinn | B29C 65/565 126/624 |
| 4,338,995 | A | 7/1982 | Shelley | |
| 4,635,710 | A | 1/1987 | Shelley | |

* cited by examiner

*Primary Examiner* — Kien Nguyen
(74) *Attorney, Agent, or Firm* — Vincent G. LoTempio; Kloss, Stenger & LoTempio; David T. Stephenson

(57) ABSTRACT

A system for regulating temperature and moisture on a field, while also absorbing an impact force from the field, uses adjacently joined panels positioned beneath the field, and that have sufficient thermal mass to transfer heat between an underlying fluid and the field. The temperature of the fluid regulates the temperature of the field, such that the field can be heated and cooled accordingly. The panels have water exfiltration and infiltration holes to drain moisture buildup from the field, and aeration channels for circulation. An interior region of each panel is defined by tube channels. The tube channel carries at least one fluid tube through the joined panels. The fluid tube carries a fluid having a predetermined temperature. The heat transfers between the fluid and the field through the plurality of panels. The temperature of the fluid can be adjusted to affect the temperature on the field.

20 Claims, 6 Drawing Sheets

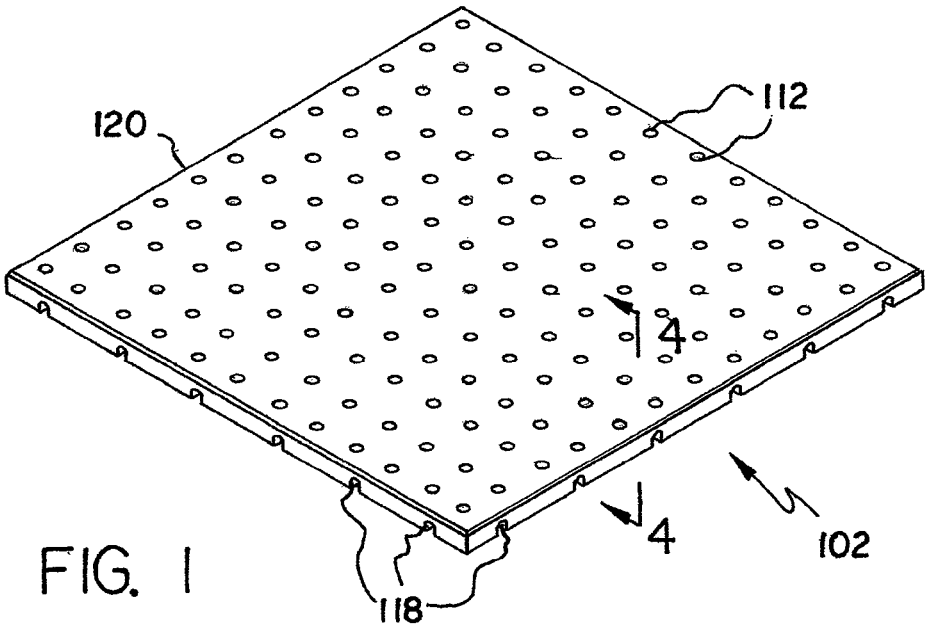
FIG. 1
FIG. 2
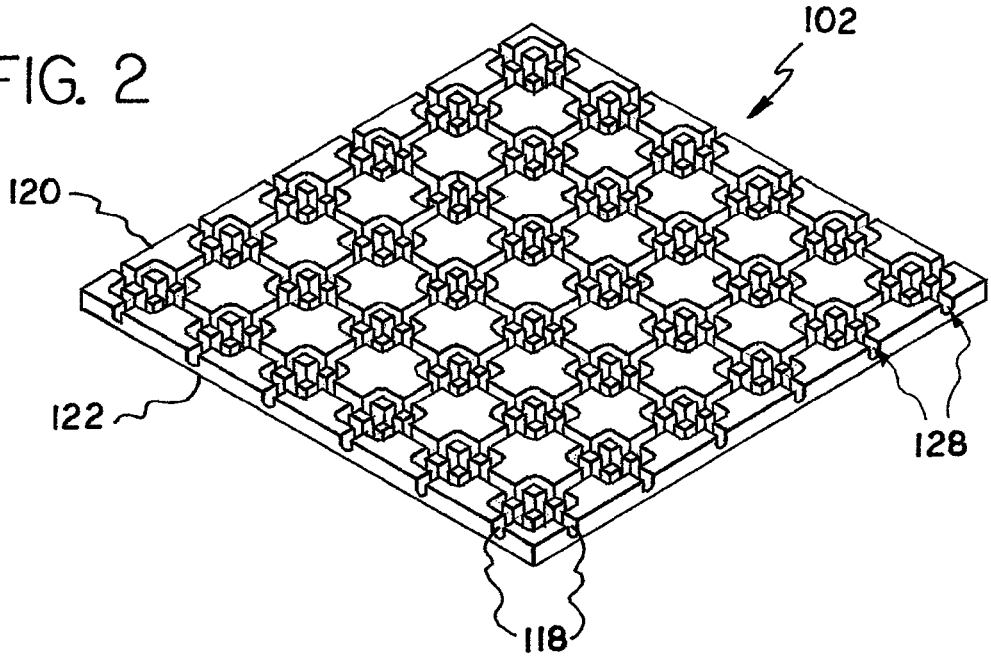

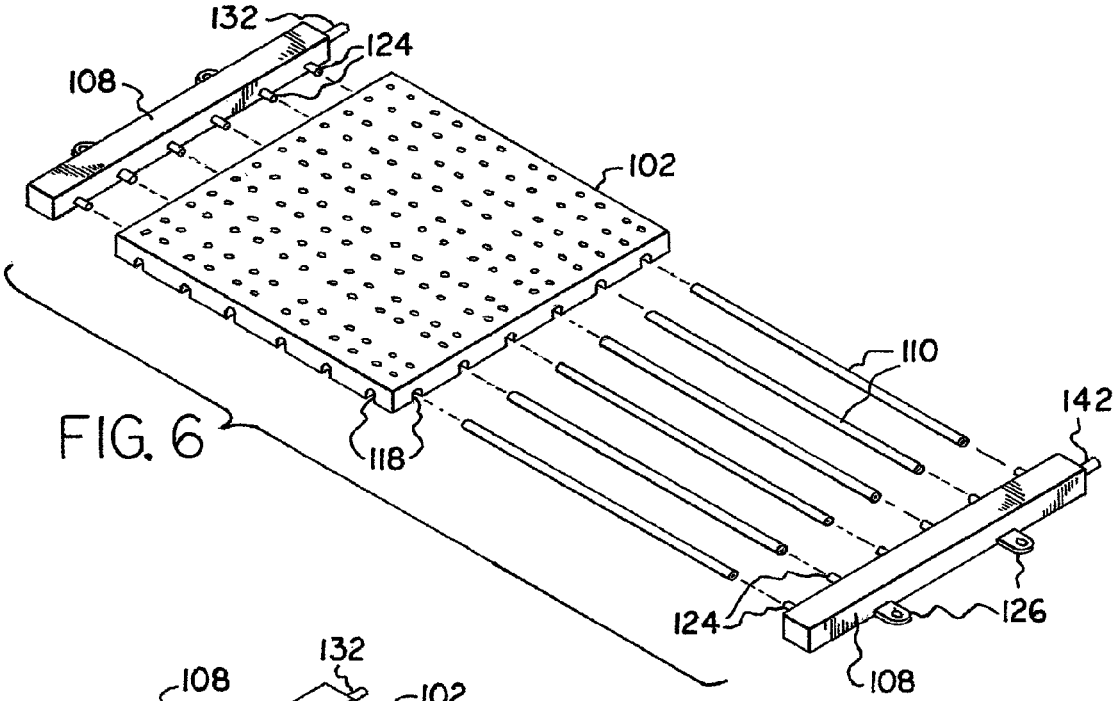
FIG. 6
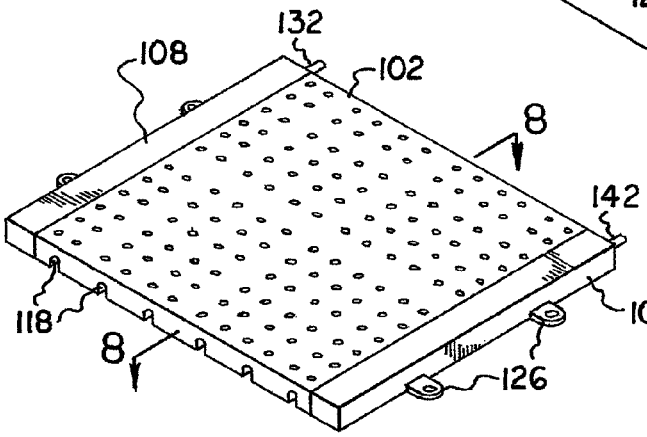
FIG. 7
FIG. 8
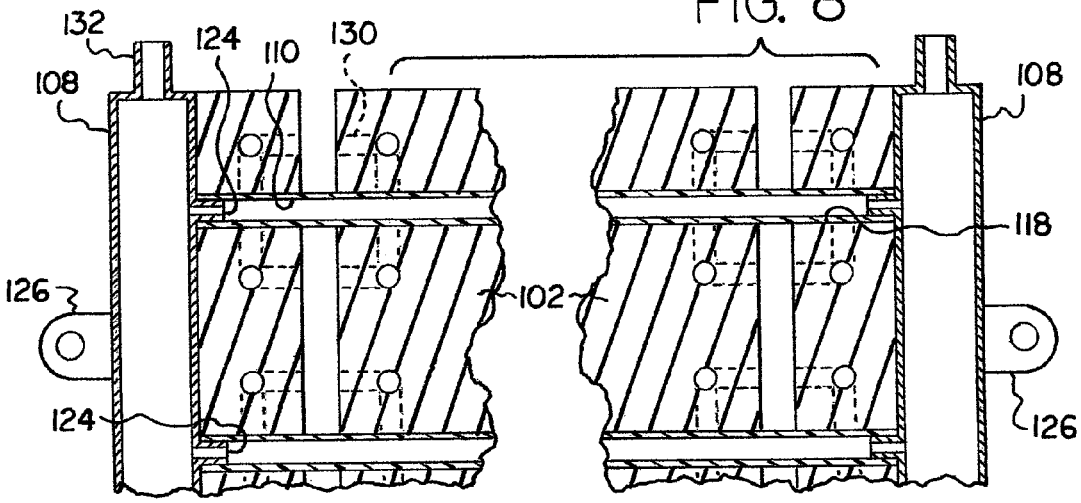

FIG. 11
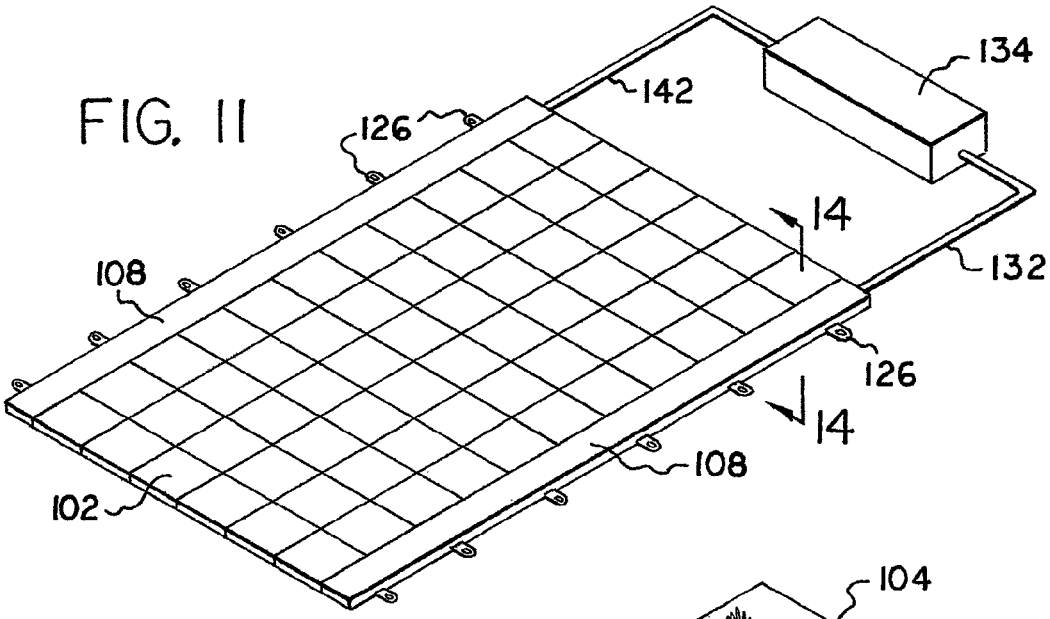
FIG. 12
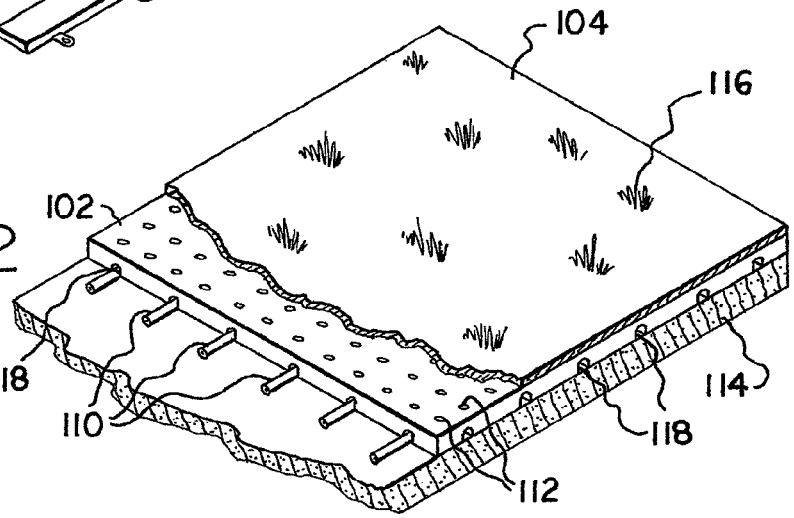
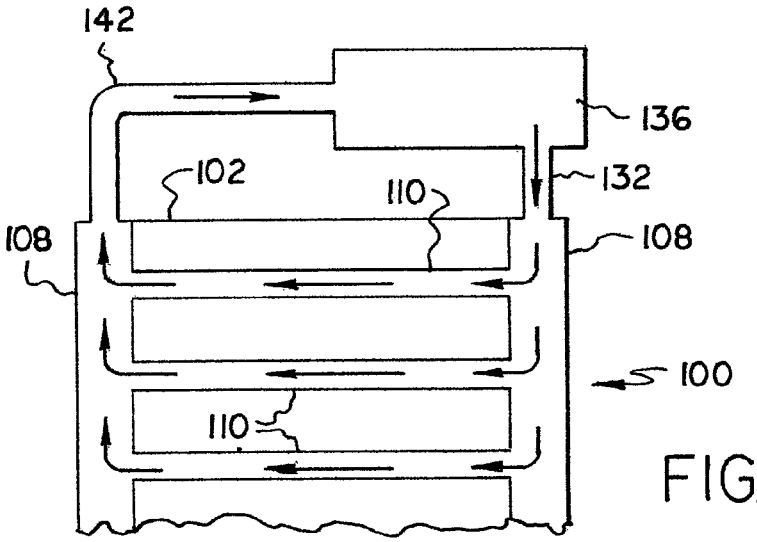
FIG. 13

SYSTEM FOR REGULATING TEMPERATURE AND MOISTURE ON A FIELD

FIELD OF THE INVENTION

The present invention relates generally to regulating temperature and moisture on a field through heat exchange, while also absorbing an impact force. More so, a system for regulating temperature and moisture on a field that uses panels having thermal mass positioned beneath the field to transfer heat between an underlying fluid and the field for the purpose of heating or cooling the field, and also the panels have elastic characteristics capable of absorbing an impact force from the field.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that a playing field is an outdoor playing surface area for a variety of different sports and activities. One example of a playing field is a football field in an outdoor stadium. Although a preferred size for a football field is about 115 yards×74 yards with an area of 7,140 square meters it suffices to say that a playing field can be a very large surface area. Typically a football field is the playing surface for the game of football, which is made of grass or artificial turf. Typically, grass is the normal surface of play, although artificial turf may sometimes be used especially in locations where maintenance of grass may be difficult due to inclement weather. Artificial turf systems are commonly used for sports playing fields and more particularly to artificial playing fields. Artificial turf systems can also be used for synthetic lawns and golf courses, rugby fields, playgrounds, and other similar types of fields or floor coverings. Artificial turf systems typically comprise a turf assembly and a foundation, which can be made of such materials as asphalt, graded earth, compacted gravel or crushed rock. Optionally, an underlying resilient base or underlayment layer may be disposed between the turf assembly and the foundation. The turf assembly is typically made of strands of plastic artificial grass blades attached to a turf backing. An infill material, which typically is a mixture of sand and ground rubber particles, may be applied among the vertically oriented artificial grass blades, typically covering the lower half or ⅔ of the blades. Artificial turf is used in areas where it is very wet, causing the grass to deteriorate rapidly. Where the turf is very dry, the grass can die; and where the turf is under heavy use, the grass can lose traction. A common problem for a playing field is it has a great capacity to retain heat causing an inclement environment above the field. Additionally, water, ice and snow can accumulate on the field causing dangerous and undesirable playing conditions.

Hydronic in-floor radiant heating systems are known in the art. Radiant heating is more efficient that other forms of heating, such as forced air, while being more cost effective. Initial systems generally used tubing within a floor structure to carry and transmit heat through the floor. Generally, the tubing is embedded within a poured concrete slab underneath the finished floor. Warm water circulates within the tubing and the stored heat is transmitted to the concrete through conduction. The warmed concrete radiates the heat to the objects within the room thereby warming objects without heating the air. In floor radiant heating systems using a cementitious heat transfer medium, requires a plastic tray and support structure, and is susceptible to chipping or fracturing of requires a plastic tray and support structure, and is susceptible to chipping or fracturing of the material. Clearly a floor radiant system using cement cementitious transfer medium cannot be used as an intermediate panel between a foundation and an artificial surface because of its rigidity and lack of G-Force flexibility.

Thus, a heretofore unaddressed need exists in the industry to address the aforementioned deficiencies and inadequacies. Even though the above cited methods for a system for regulating temperature on a field meets some of the needs of the market, a system for regulating temperature on a field with cooling and heating panels positioned adjacently beneath the field, while absorbing impact force from the field is still desired.

SUMMARY OF THE INVENTION

The present invention is directed to a system for regulating temperature and moisture on a field, and absorbing an impact force from the field. The system uses panels that serve as heat transfer mediums between the field and an underlying fluid. The panels position beneath the field, and have sufficient thermal mass to transfer heat between the fluid flowing through the panel and the field. The temperature of the fluid regulates the temperature of the field, such that the field can be heated and cooled accordingly. The panels also serve to drain moisture buildup from the field.

The plurality of panels join adjacently to each other beneath the field. The panels follow the shape and dimensions of the field, which can include a grass or turf covered field used in an outdoor stadium. An interior region of each panel is defined by at least one tube channel. The tube channel from each panel is oriented to match an adjacent panel and form a grid pattern beneath the field. The panels are sufficiently resilient so as to absorb G-force impact from the overlaying field.

The at least one tube channel carries at least one fluid tube through the joined panels. A pump forces a fluid through the fluid tube so that the fluid flows through the entirety of the joined panels inside the fluid tubes. The panels are fabricated from a material having a thermal mass sufficient to absorb, transfer, and store heat through standard heat exchange. The heat transfers between the fluid and the field through the plurality of panels. In this manner, the temperature of the fluid can be adjusted to affect the temperature on the field. Not all tube channels carry fluid tubes and unoccupied channels are used to accommodate air flow around and through the multiplicity of joined panels.

The fluid tubes are spaced along the panels to optimize system performance. Similar to the panels, the fluid tubes absorb an impact force, such as a G-force shock. If the fluid tubes are too close together, the panels lose the ability to absorb the impact force and the girth of the thermal mass; thereby reducing the panel protection of the fluid tubes. The tube routing system is depicted is designed for optimum isotherm distribution and energy delivery without compromising the other features of the system.

In some embodiments, the panels also include a plurality of water exfiltration holes that pass through the panels and connect with the fluid tube. The water exfiltration holes capture and carry away excess moisture from the overlying turf on the field. The moisture can be pumped away from the panels through the fluid tube to expedite the drainage of moisture from the field. Conversely, fluid can be pumped from the fluid tubes towards the water exfiltration holes and the field, if needed.

A first aspect of the present invention provides a system for regulating temperature and moisture on a field, comprising:

a plurality of panels arranged adjacently beneath a field, the plurality of panels comprising an interior region, the interior region defined by at least one tube channel configured to carry at least one fluid tube, the at least one fluid tube configured to enable a fluid to flow through the interior region, the plurality of panels further comprising a thermal mass configured to absorb and transfer heat, the plurality of panels and the at least one fluid tube further comprising a resilient composition for absorbing an impact force from the field, wherein the plurality of panels transfer heat between the fluid and the field, the interior region further defined by at least one aeration channel configured to enable air flow beneath the plurality of panels, the plurality of panels further comprising a plurality of water exfiltration holes operatively joined with the at least one fluid tube, the plurality of water exfiltration holes configured to enable passage of moisture from the field through the at least one fluid tube.

In a second aspect of the present invention, the system is operable to regulate temperature by transferring heat from the plurality of panels to the field for snow and ice melting applications.

In another aspect, the system is operable to regulate temperature by absorbing heat from the field to the plurality of panels for cooling the field.

In another aspect, the system is operable to enable drainage and exfiltration of moisture on the surface of the field.

In another aspect, the plurality of panels comprise a rubber like material having a thermal mass for absorbing and transferring heat.

In another aspect, the plurality of panels comprise a recycled rubber material.

In another aspect, a turf covers an upper surface of the plurality of panels.

In another aspect, the plurality of panels rest on a subsurface.

In another aspect, the subsurface comprises asphalt, gravel, soil, or concrete.

In another aspect, the fluid comprises water or an antifreeze solution.

In another aspect, the at least one tube channel forms a grid pattern on the lower surface of the plurality of panels.

In another aspect, each tube channel orients in alignment with an adjacent tube channel from an adjacent panel.

In yet another aspect, the system comprises a pump configured to force the fluid through the at least one fluid tube.

In yet another aspect, system comprises a modular manifold arranged around a periphery of the field and the plurality of panels, the modular manifold configured to fasten the plurality of panels to the field.

In yet another aspect, the modular manifold comprises a barrier lock configured to engage the at least one fluid tube.

In yet another aspect, the modular manifold comprises a barrier handle configured to enable movement of the modular manifold and the joined panels.

In yet another aspect, the field comprises a series of force absorbing panels below a large playing field such as a football or soccer field.

It is one objective of the present invention to provide an improved temperature regulation system for a large surface area such as a field within a stadium.

It is another objective to provide heat exchange panels with an improved heat transfer material to create the thermal mass for efficient heat exchange with a fluid that flows beneath the panel.

It is another object of the disclosure to provide an improved panel wherein the improved heat transfer material is comprised of completely recycled materials.

It is still another objective of the disclosure to provide improved panels which can be configured to form the shape of the field.

It is still another object of the disclosure to provide panels with internal fluid tubes that follow routing channels that enable multiple tube channel combinations between each adjacent panel.

It is another object of the disclosure to provide panels that can be used for both radiant heating and radiant cooling.

It is another object of the disclosure to provide an improved modular system comprising multi-panel installation beneath the field.

It is another object of the disclosure to provide panels that present a flexible force absorbing series of panels to be covered by artificial turf or other field surface.

It is another object of the disclosure to provide a temperature regulation system for use in radiant snow and ice melting applications.

It is another object of the disclosure to provide a system for drainage and exfiltration of moisture on the surface of the field.

It is another object of the disclosure to provide panels that can be installed on existing wood sub-surface such as asphalt, gravel, soil, or concrete.

It is another object of the disclosure to provide panels fabricated in a single-body construction or of a multi-directional modular construction.

The present disclosure also provides methods for regulating the temperature of a field with panels having thermal mass for efficient heat exchange.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The present disclosure and the manner in which it may be practiced is further illustrated with reference to the accompanying drawings wherein:

FIG. 1 is a top perspective view of the underlayment panel of the instant invention;

FIG. 2 is a bottom perspective view of the underlayment panel;

FIG. 6 is an exploded view of system components using only one modular panel;

FIG. 7 is an assembled view of the panel, containment locking device and manifold;

FIG. 8 is a cross-sectional view taken generally along line 8-8 of FIG. 7 in accordance with the present disclosure;

FIG. 11 is a perspective view of a completed panel underlayment with a multiplicity of panels attached to a fluid delivery mechanism;

FIG. 12 is a cut away perspective view of a typical panel installation between a subsurface surface and a turf field;

FIG. 13 is a cross-sectional view of showing a flow of liquid through the conduit tubes from the mechanical room and delivery system area throughout this system;

Like reference numerals refer to like parts throughout the various views of the drawings.

DETAILED DESCRIPTION OF THE INVENTION

Figure 3:
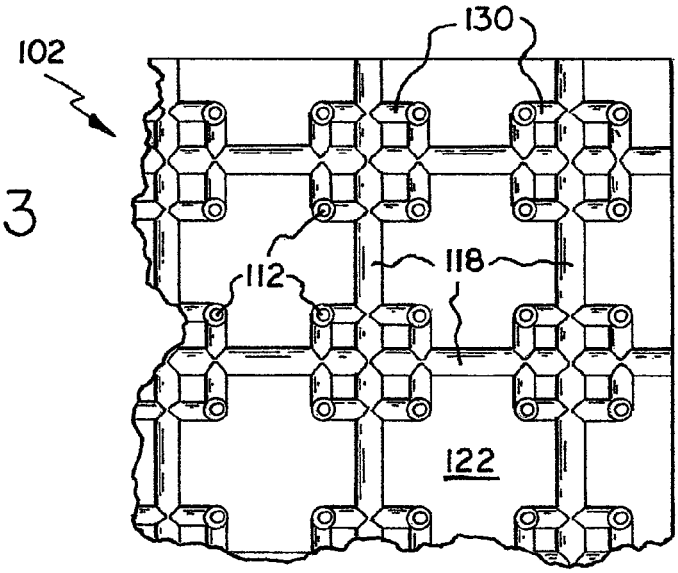
FIG. 3 is an enlarged partial view that illustrates the of bottom of the panel.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present disclosure presented in FIGS. 1-16, a system 100 for regulating temperature and moisture on a field creates a climate controlled environment on a field 104, through a heat transfer. Typically, heat transfer describes the exchange of thermal energy, between physical systems depending on the temperature and pressure, by dissipating heat. Systems which are not isolated may decrease in entropy. The fundamental modes of heat transfer are conduction or diffusion, convection, advection and radiation. Field 104 may include, without limitation, a football field, an outdoor stadium field, a pitch, and a playing field. The heat on the field can be transferred to a liquid and carried away. Also, heat can be transferred from a liquid carried in a tube into the field. Advection is the transport mechanism of a fluid substance or conserved property from one location to another, depending on motion and momentum. Conduction is the transfer of energy between objects that are in physical contact. Thermal conductivity is the property of a material to conduct heat and evaluated primarily in terms of Fourier's Law for heat conduction. In a preferred embodiment of the present disclosure, the temperature of field 104 is regulated by transferring heat to field 104 for melting snow and ice. In another embodiment, the temperature of field 104 is regulated by absorbing heat from field 104 into a lower temperature liquid carried by at least one fluid tube 110 through the joined panels 102 for cooling field 104. In yet another embodiment, system 100 is operatively arranged to enable drainage of moisture from field 104 and also absorb impact from field 104.

Adverting now to the drawings, with reference to FIG. 1, a preferred embodiment of the present disclosure is illustrates a front perspective view of a radiant underlayment panel 102. A plurality of panels 102 are used to assemble a temperature changing subsurface, for a surface that lays on top of the panels such as a field 104. Panels 102 are also sufficiently resilient as to absorb G-force from the overlying field 104. Panel 102 includes an interior region 128 having a thermal mass for absorbing and transferring heat. The interior region 128 includes at least one radiant tube channel 118 and a plurality of water exfiltration holes 112 that can also be used as a drain for water exfiltration. Tube channels 118 are pre-formed and pre-spaced. Thermal distribution is dependent on tube diameter and spacing of the tubes in addition to material composition of the panels. Panel 102 consists of a thermal mass product made from a reinforced fiber like material such as rubber, recycled rubber, or a polymer. The panel is made of material that is dependent on the application, such as resistance to abrasion and chemical resistance. Other materials such as silicate, synthetic polymers, nylon, rubber, recycled rubber, EPDM, ethylene, nitrile, butadiene, isobutene, iso-propene, SBR, butyl hypalon, urethane, fluoro silicon, carbon, plastic carbon, carbon fiber, nylon fiber and other solid surface acrylics are examples of materials used in the construction of the panels. It should be appreciated that other suitable materials, other than the aforementioned materials can be used in the manufacture of the panel.

Figure 10:
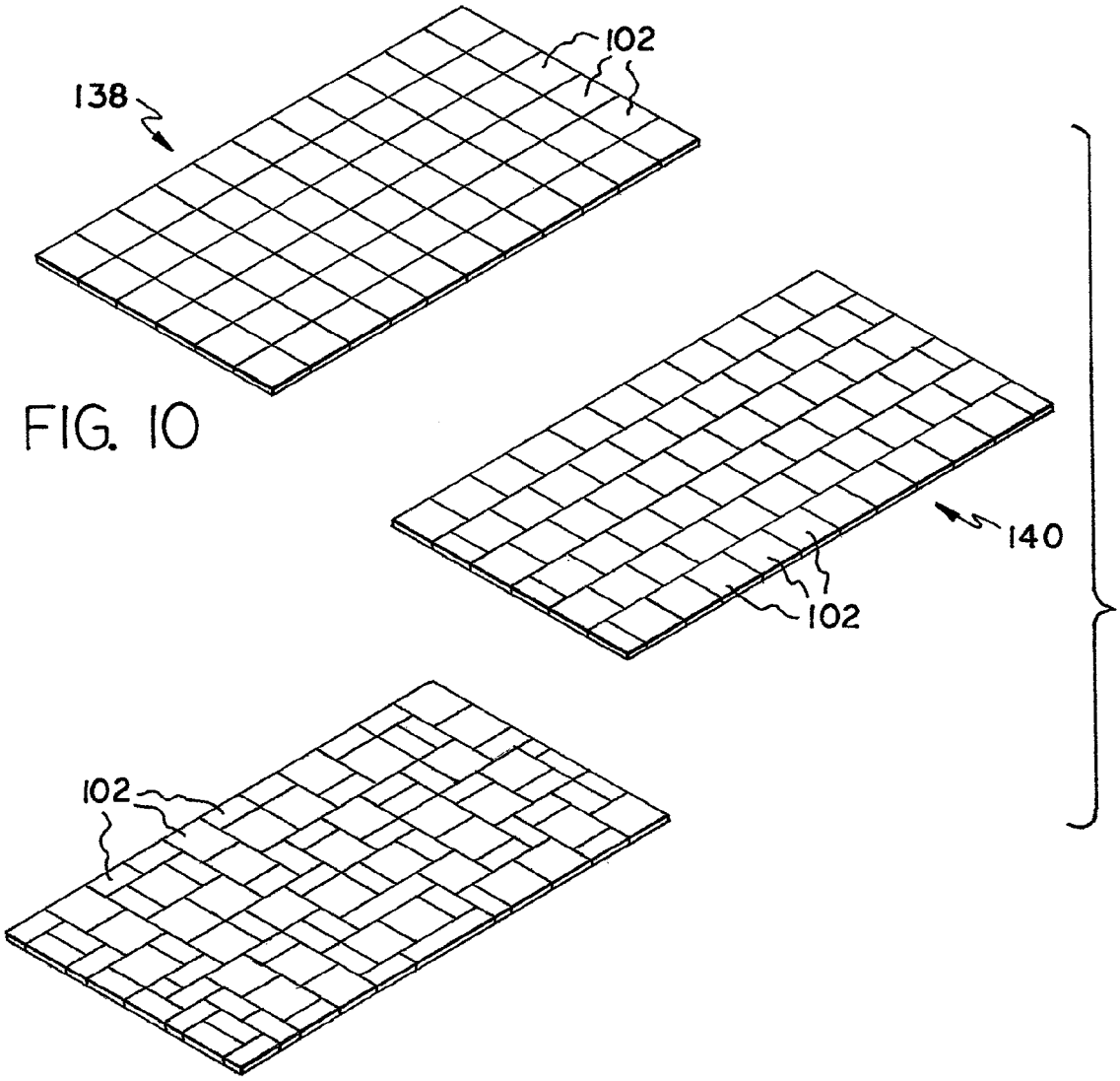
FIG. 10 illustrates various combinations of panels in symmetrical patterns aligned so that a friction bond is formed between each individual panel.

Although it is preferred to position the panels with the tube channels facing down the panels can be used either side up or down. The weight of the panels can be manipulated by adding or reducing the amount of holes. Because the reinforced fiber panels have a modular configuration each panel can be cut or shaped for various applications and configurations of the field (as shown in FIG. 10). Modular panels can be removed or replaced through nondestructive relocation without affecting the entire field. The tube channels 118 hold thermal energy delivered by at least one fluid tube 110 into the thermal mass of the panel 102 for thermal storage. The fluid tubes 110 are spaced so that to fix the delivery to within the panel 102 in a design to optimize system performance. If the fluid tubes 110 are too close together, the panels 102 lose the ability to absorb G-Force shock impact and girth of the thermal mass thereby reducing the panel 102 protection of the fluid tubes 110. The tube routing system is depicted is designed for optimum isotherm distribution and energy delivery without compromising the other features of the system 100. Tube channel 118 prevents the fluid tube 110 from moving location and protects the fluid tube 110 from damaging forces.

FIG. 2 is a perspective view of the lower surface of panel 102 depicting at least one tube channel 118 passing in multiple directions through interior region 128 of panels 102. The multi-directional tube channel allows for installation flexibility so that each panel used in conjunction with other panels can be used in a multiplicity of field configurations. FIG. 2 further illustrates an interior region 128 of each panel 102 that is defined by at least one tube channel 118 traverses the length of the panel 102, forming a grid pattern in the interior region 128 and lower surface 122. It should be understood that in other embodiments, the tube channel 118 can form other patterns, including, an S-shaped pattern, a crisscross pattern, and a zig-zag pattern. Tube channel 118 terminates at a terminal point at the edge of the panel 102. Each terminal point of the tube channel 118 is oriented to match an adjacent terminal point from an adjacent panel 102 to form a continuous tube channel 118 through joined panels 102.

Tube channel 118 is sufficiently resilient and flexible to provide protection against G-force impact from overlaying field 104. The thermal mass of panel 102 is also similarly resilient against G-force impact so as to be usable with fields in which contact sports are played, such as football, rugby, where players impact the turf with great force.

FIG. 3 illustrates an enlarged partial view of a lower surface 122 of the panel 102 depicted in FIG. 2. This figure depicts the cross-linking of a plurality of water exfiltration holes 112 and multi directional aeration channels 130 which serve as water, snow and air exfiltration holes and channels to accommodate removal of liquid from the overlaying field. The cross-linked water exfiltration holes 112 also aid in isotherm distribution and thermal conductivity through airflow and liquid removal. FIG. 3 also shows the at least one tube channel 118 carrying at least one fluid tube 110 through panel 102.

Figure 4:
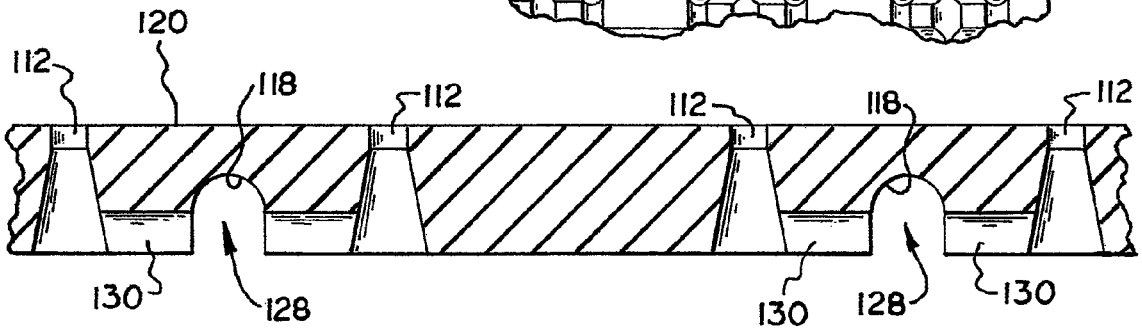
FIG. 4 is a cross-sectional view taken generally along line 4-4 in FIG. 1.

FIG. 4 illustrates a cross-sectional view taken generally along line 4-4 in FIG. 2. This view depicts tube channel 118, multi directional aeration channels 130, and the exfiltration holes 112, where multidirectional exfiltration holes 112 are thermal transfer system and thermal transfer holes and acting as distribution channels for water and air exfiltration. The tube channel 118 carries the fluid tube 110 along the panels 102. The fluid tube 110 enables flow of the fluid to exchange heat with the panel 102, and the filed 104. The aeration channel 130 can be multidirectional and enable the free flow of air to improve field 104 conditions. The exfiltration holes 112 help with drainage on the field 104, as gravity drains the excess moisture down to subsurface 114.

Figure 5:
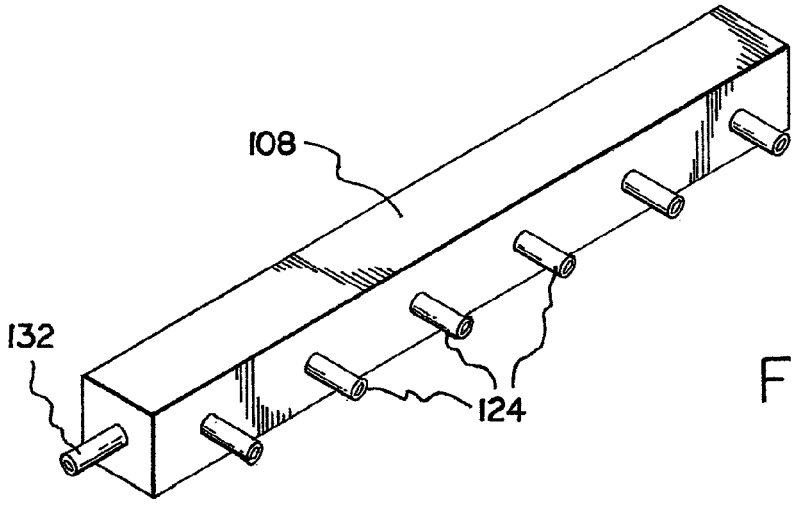
FIG. 5 illustrates a perspective view of the containment locking device and modular manifold.

FIG. 5 illustrates a perspective view of a modular manifold 108 and at least one connection tube 124 that ensures that the modulated underlayment panel 102 stay in place when forming a surface assembly. Modular manifold 108 is arranged around a periphery of the field 104 and the panels 102. The fluid enters the system 100 from four possible locations on the modular manifold 108 before passing into the fluid tube 110. An edge containment device runs the length of the field 104 as a fluid source supply tube 132 to supply fluid to the fluid tube 110 in the tube channel 118. The manifold can contain a variety of valves, T-joints, and thermostats to help control temperature, speed, and direction of the fluid before entering the interior region 128 of panels 102.

FIG. 6 illustrates an exploded view of the components of the system 100 using only one modular panel 102. Fluid tube 110 is configured to couple to the inside surface of the tube channel 118, resting snuggly within the formed cavity. Fluid tube 110 is configured to carry a fluid having a predetermined temperature. The fluid may include, without limitation, water, anti-freeze, and a gas. In some embodiments, a pump forces the fluid through the fluid tube 110 so that the fluid flows through the entirety of the joined panels 102 inside the fluid tubes 110. The pump may include a configuration having a pair of pumps on each side of the field 104 that push and pull the fluid through the at least one fluid tube 110. Clearly it should be understood that this component system can use a multiplicity of panels 102 to accommodate any size field. The larger the field the more volume needed inside each panel 102 therefore each panel 102 should be sized per volume based on size of the field and climate. Volume of fluid in the system is dictated by the surface area of the field. The tube routing centers are constant aids in the formulation of isotherm distribution and BTU output for heating, cooling, and thermal distribution.

FIG. 7 is an assembled view of panel 102, containment locking device 126 and modular manifold 108. The modular manifold 108 is arranged around a periphery of the field and the panels. The fluid enters the system 100 from four possible locations on the modular manifold 108 before passing into the fluid tube 110. The modular manifold 108 is made up of manifold exit and entrance ports are located at various positions to accommodate electronic pumps and pumping system delivery pumps that are capable of both pushing and pulling the liquid through the system 100. In an embodiment of the instant disclosure the system 100 is configured to change direction of the fluid every 15 minutes to provide for system balance and equilibrium, this is especially necessary to maintain equilibrium for large fields 104. In conjunction with the delivery system are variable speed pumps that are calibrated to the correct speed based upon the size of the field 104 so that the fluid is equally distributed and maintains a consistent temperature throughout the field 104. Speed and temperature of fluid can also be regulated based upon climate changes while the system 100 is in operation.

FIG. 8 illustrates a cross-sectional view taken generally along line 8-8 of FIG. 7. This view is a cutaway view of the fluid tubes 110 connected to containment locking device 124. As can be seen from this cross-sectional view, the fluid delivery manifold 108 works in conjunction with fluid tubes 110 and the panels 102 thermal mass body and thermal storage. As can be readily observed the conduit spacing and tube channels 118 are depicted so that the optimum thermal storage and distribution is maintained during operation. Modular manifold 108 fastens the panels 102 to the field 104 through a containment locking device 124. Containment locking device 124 may include a ring that extends from the side of the manifold 108. An anchor or rod can pass through the containment locking device 124 to secure the manifold 108, the panels 102, and the field 104 to the subsurface 114.

The modular manifold 108 also facilitates drainage of the field 104 by restricting moisture from flowing onto the field 104 from extremities.

Figure 9:
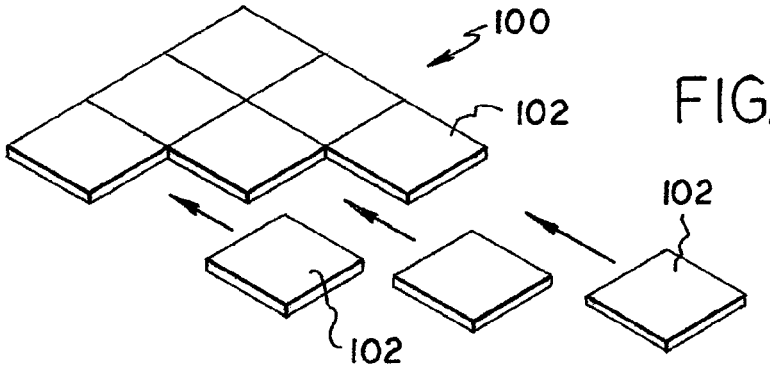
FIG. 9 is a perspective view of a multiplicity of panels placed together to form a surface area.

FIG. 9 illustrates a perspective view of a multiplicity of panels 102 placed together to form a surface area. In this embodiment of the disclosure, the panels 102 are placed together in a symmetrical pattern that comprises an assembly of panels 102 to create a thermal mass sub-surface. As can be clearly understood the quantity of panels 102 is dictated by the size of the service area that needs climate control either indoors and outdoors.

FIG. 10 illustrates various combinations of panels in symmetrical patterns aligned so that a friction bond is formed between each individual panel. A preferred combination of panels 102 is in a pattern symmetrically aligned similar to a wall of bricks. Alternating panels 102 allow for control of movement of panels 102 and protection of fluid tubes 110 within the tube channels 118. In some embodiments, a first panel section 138 and a second panel section 140 join together to form the underlying thermal panels beneath the field. However, the panels 102 can be combined in any size, shape or dimension to join together. Although these are a few of preferred combinations of panels, any combination of patterns of panels 102 could also be employed with the system 100. Tube channels 118 are multi-positional within the panels so that there is symmetry from a multiplicity of different possible angles for the panel placement and layout. Flexibility of design and installation methods can be achieved through many different combinations of placement of panels. The water exfiltration holes 112 can be lined up at the corners, at the middle or completely straight up on panels 102. The tube channels are spaced to accommodate fluid tubes. The tube routing channels are spaced to provide exact alignment to the adjoining panels during installation. The tube routing spacing enables the panels to be installed in full, half or quarter intervals to stagger or alternate the seams in the layout and design installation. The layout pattern can be measured and installed with marking location points or using pre-molded tube channels for alignment and location. The panels can also be cut to contour or change the length or width of the panel as each installation site dictates. The installation requires laying down the panels over the tube or layout points to a friction fit to the adjoining panels in a predetermined grid pattern.

FIG. 11 is a perspective view of a completed panel underlayment with a multiplicity of panels attached to a fluid delivery mechanism. Fluid delivery mechanism 134 and related equipment could include geothermal pumps capable of both pushing and pulling the liquid throughout the system. The system 100 could also be afforded with multiple pumps connected at different locations. Although this embodiment shows only one pump the system certainly could incorporate additional multidirectional, variable speed, variable temperature pumps. The pumping mechanism could also include heat exchangers and evaporators, and or chilling devices such as refrigerants and heating devices such as fossil fuel or solar energy.

FIG. 12 illustrates a typical panel 102 installation between a subsurface 114 and field 104. In this embodiment of the disclosure the subsurface 114 is either a gravel, concrete or asphalt surface which is below the thermal mass panels which contain the fluid tubes. The field can be made from many materials but in this embodiment described in this disclosure the field is made of artificial turf 116 or other synthetic or man-made material surface. Field 104 is laid on top of panels 102. Turf 116 can be a surface that is permeable for rain and water and snow and the field surface is in fluid communication with water exfiltration holes 112. Located on the side of the thermal mass panel 102 are at least one aeration channel 130 that accommodates both water and air circulation below field 104. Although the preferred embodiment is shown with only one center panel 102 an additional panel 102 can be placed below this panel 102 between another layer of gravel to increase the seismic control and G-Force shock characteristics of the field 104. The installation of the panels take place after the sub soils, sub-base compaction, contouring other considerations such as pitch, slope and drainage are addressed so as to accommodate the intended use. The installation can include fluid tubes in molded or pre-molded channels provided in the panel. A frame stop ledge or manufactured border and or combination manifold border containment is used typically on the installation perimeter. The panels can be attached to each other when the installation would warrant using tie straps or other attachment means including chemical bond. The panels can be attached to a subsurface using mechanical means such as screws, nails, or bolts.

The system 100 uses a plurality of panels 102 that join adjacently to each other beneath the field 104. The panels 102 generally follow the shape and dimensions of the field 104, with each panel 102 having a generally square or rectangular shape. Each panel 102 forms a single body construction with dimensions of about 4'×4'. In one embodiment, the field 104 may have a turf that forms an outer playing surface. Each panel 102 has an upper surface 120 that engages the turf. The turf may include artificial turf or natural grass sections. In the instant example of this disclosure field 104 consists of artificial turf 116. In either case, the turf is removed or rolled to enable installation of the plurality of panels 102. A lower surface 122 of the panel 102 is oriented to rest atop a subsurface 114. The subsurface 114 may include, without limitation, asphalt, gravel, soil, or concrete. The panel 102 helps provide cushion from impact against the generally harder subsurface 114.

FIG. 13 illustrates a flow of liquid through the fluid tubes 110 from a mechanical room 136 and delivery system area throughout the system 100. The fluid is supplied through the manifolds 108 to the fluid source supply tube 132 and a return tube 142 under the embodiment shown of the radiant panel 102. It should be understood that although the arrows indicate the general direction of the fluid, the system 100 is configured to allow for the direction to reverse so as to maintain equilibrium throughout the system 100. System balance is important for thermal transfer and maintaining system 100 performance. System 100 efficiency is directly related to balance and equilibrium.

Figure 14:
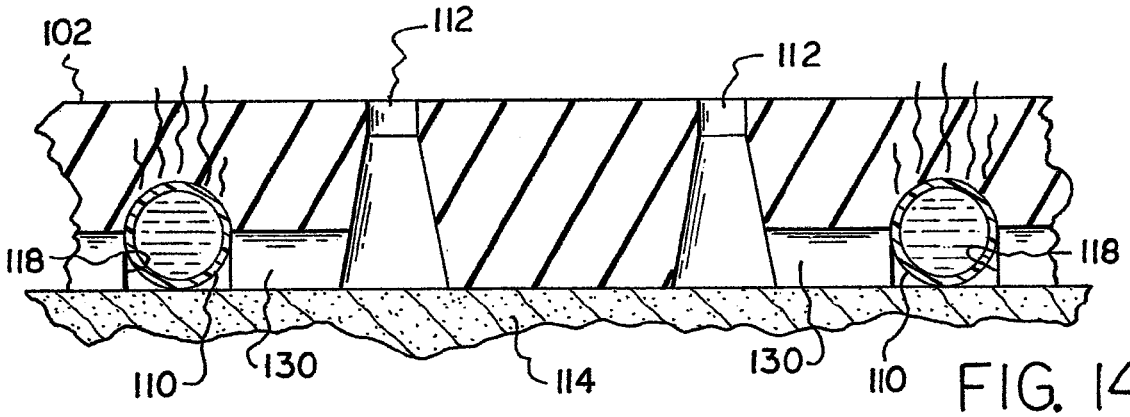
FIG. 14 is a cross-sectional view of a panel taken generally along lines 14-14 of FIG. 11.

FIG. 14 illustrates a cross-sectional view taken generally aligned 14-14 of FIG. 11. This cross-sectional view to PACs the tube channel 118 in relationship to the thermal mass of the panel 102 in the fluid delivery to encapsulated by the thermal plants. This illustration also depicts the isothermal distribution and heat/cold temperature transfer to regulate and control the temperature of the surface area of the field 104 above the panels 102. Thermal transfer controls temperature of the field 104 and the environment above the field 104. It should be understood that use of this thermal transfer allows for the climate control of the environment within a domed stadium or other enclosed facility. It also allows for control of environment proximate the field 104 of an open stadium or outdoor facility.

FIG. 14 also depicts the panels 102 dissipating heat to the field 104. The panels 102 form a heat exchange medium, and are fabricated from a material having a thermal mass sufficient to absorb, transfer, and store heat. In this manner, the heat transfers between the fluid and the field 104 through the panels 102. Additionally, the temperature of the fluid can be adjusted to affect the temperature on the field 104. It is known in the art that, advection is the transport mechanism of a fluid substance or conserved property from one location to another, depending on motion and momentum. Conduction is the transfer of energy, such as heat, between objects that are in physical contact. The fluid in the present invention transfers heat to and from the at least one fluid tube 110, which further transfers the heat to and from the panels 102. The panels 102 have sufficient thermal mass to heat or cool the field 104 accordingly.

For example, without limitation, an anti-freeze/liquid composition is pumped through the at least one fluid tube 110. The capacity of anti-freeze to lower the boiling point of the water enables convective heat transfer from the field to the antifreeze/water composition, consequently cooling the field 104. In another example, heated liquid is pumped through the at least one fluid tube 110. The heat from the heated liquid is absorbed by the panel 102 and transferred to the field 104 to prevent icing. Suitable materials for the panels 102 may include, without limitation, rubber, polymers, polyurethane, polyvinyl chloride, vulcanized compositions, and completely recycled materials.

Figure 15:
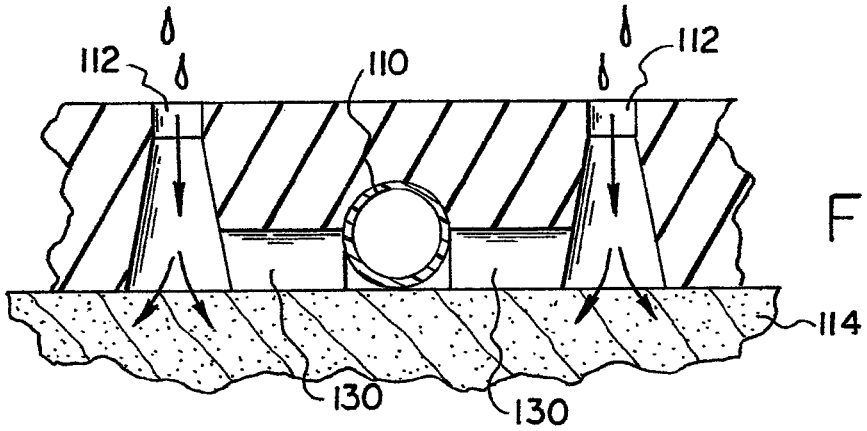
FIG. 15 is a cross-sectional view of a panel showing the water exfiltration holes.

FIG. 15 illustrates a cross-sectional view of a panel 102 showing the water exfiltration holes 112. The panels 102 include a plurality of water exfiltration holes 112 that open up from the upper surface 120 and connect with the fluid tube 110 at the lower surface 122. The water exfiltration holes 112 pass completely through the panel 102 and mate with the ends of the fluid tube 110. The water exfiltration holes 112 capture and carry away excess moisture from the overlying turf on the field 104. FIG. 15 shows moisture moving through the panels 102 to expedite the drainage of moisture from the field 104. For example, rain soaks the turf and seeps through the turf before finally passing through the water exfiltration holes 112. The water exfiltration holes 112 are multidirectional and allow the transfer of water through the above thermal mass to the subsurface 114 and ultimately to drain through gravity into the ground. The system 100 can also be used in conjunction with the drainage system and drains that are located below the field 104. To receive rainwater and snowmelt as the temperature the field 104 increases to keep an accumulation of snow from covering the surface of the field 104. This drainage system also allows for the system 100 to be cleaned with a liquid that transfers through the permeable turf through the exfiltration holes 112, as depicted in FIG. 14, and escape to the subsurface 114 drainage system.

Figure 16:
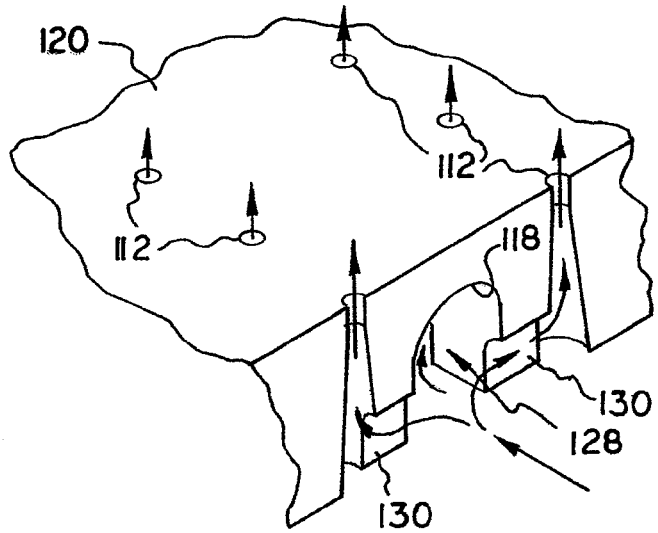
FIG. 16 illustrates a tube routing channel in a panel that does not contain a heating/cooling tube used for airflow and energy transfer.

FIG. 16 illustrates at least one aeration channel 130 that does not contain a heating/cooling fluid tube 110. In the preferred embodiment of the typical installation of a heated field, all fluid channels 118 are not occupied by fluid tubes 110. The vacant aeration channels 130 are operatively arranged to accommodate airflow throughout the system 100. Heated or cooled air can be injected into the system 100 or the system 100 can be operated by natural convection properties allowing movement throughout each panel 102 and the proximity of fluid tube 110 so as to aid in the balance and equilibrium the system 100. The system 100 performance is also related to the aeration channels 130. Air movement also aids in the drainage of the system. Air movement also maintains open channels 130 so that they become block it resistant. The multidirectional aeration channels 130 aid in preventing blockage and water drainage. In some embodiments, the aeration channel 130 forms in each lower surface 122 of the panel 102. The aeration channel 130 enables air to circulate beneath the panels 102, which helps maintain coolness and dryness for the overlying turf. The at least one aeration channel 130 may form a rectangular shape and include multiple aeration channels 130 for each panel 102. In one alternative embodiment, air can be blown through the aeration channel 130 with an air pump or similar device. The pump may then suck the rain for discharge beyond the modular manifold 108. In this manner, the field 104 is maintained in better condition for play. Conversely, the fluid can be pumped in the opposite direction, towards the water exfiltration holes 112 and the field 104, if needed.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A system for regulating temperature and moisture on a field, and absorbing impact from the field, the system comprising:

a plurality of panels arranged adjacently beneath a field, the plurality of panels comprising an interior region, the interior region defined by at least one tube channel configured to carry at least one fluid tube, the at least one fluid tube configured to enable a fluid to flow through the interior region, the plurality of panels further comprising a thermal mass configured to absorb and transfer heat, wherein the plurality of panels transfer heat between the fluid and the field, the plurality of panels and the at least one fluid tube further comprising a resilient composition for absorbing an impact force from the field, the interior region further defined by at least one aeration channel configured to enable air flow beneath the plurality of panels, the plurality of panels further comprising a plurality of water exfiltration holes operatively joined with the at least one fluid tube, the plurality of water exfiltration holes configured to enable passage of moisture from the field through the at least one fluid tube.

2. The system of claim 1, wherein the system is operable to regulate temperature by transferring heat from the plurality of panels to the field for snow and ice melting applications.

3. The system of claim 2, wherein the system is operable to regulate temperature by absorbing heat from the field to the plurality of panels for cooling the field.

4. The system of claim 3, wherein the system is operable to enable drainage and exfiltration of moisture on the surface of the field.

5. The system of claim 4, wherein the plurality of panels comprise a rubber material having a thermal mass for absorbing and transferring heat.

6. The system of claim 5, wherein the plurality of panels comprise a recycled rubber material.

7. The system of claim 6, wherein a turf covers an upper surface of the plurality of panels.

8. The system of claim 7, wherein the plurality of panels rest on a sub-surface.

9. The system of claim 8, wherein the subsurface comprises asphalt, gravel, soil, or concrete.

10. The system of claim 9, wherein the at least one tube channel forms a grid pattern on the lower surface of the plurality of panels.

11. The system of claim 10, wherein each tube channel orients in alignment with an adjacent tube channel from an adjacent panel.

12. The system of claim 11, wherein the fluid comprises water or an antifreeze solution.

13. The system of claim 12, wherein the system comprises a fluid delivery mechanism configured to force the fluid through the system.

14. The system of claim 13, wherein the fluid delivery mechanism is controlled from a mechanical room.

15. The system of claim 14, wherein the system comprises a modular manifold arranged around a periphery of the field and the plurality of panels, the modular manifold comprising a fluid source supply tube, the fluid source supply tube configured to discharge the fluid into the at least one fluid tube through the modular manifold.

16. The system of claim 15, wherein the modular manifold comprises at least one connection tube configured to engage the at least one fluid tube for fastening the modular manifold to the plurality of panels.

17. The system of claim 16, wherein the modular manifold comprises a barrier handle configured to enable movement of the modular manifold and the joined panels.

18. The system of claim 17, wherein the field comprises a football field.

19. A method for regulating temperature and moisture on a field, and absorbing impact from the field, the method comprising:

orienting a plurality of panels to join together and to align at least one tube channel;

joining the plurality of panels under a field;

fastening the plurality of panels to the field with a modular manifold;

pumping a fluid through at least one fluid tube that passes through the at least one tube channel;

transferring heat between the fluid and the field through the plurality of panels;

absorbing, by the plurality of panels and the at least one fluid tube, an impact force from the field;

aerating the plurality of panels and the field with at least one aeration channel; and draining moisture through a plurality of water exfiltration holes in the plurality of panels.

20. The method of claim 19, wherein the step of aerating the plurality of panels and the field with at least one aeration channel includes forced air flowing through the at least one aeration channel to cool or heat the field.

* * * * *